US009421591B2

(12) United States Patent
Thurner

(10) Patent No.: US 9,421,591 B2
(45) Date of Patent: Aug. 23, 2016

(54) METHOD AND DEVICE FOR PRODUCING CONICAL PIPE SECTIONS IN HELICAL FOUNDATIONS

(75) Inventor: Guenther Thurner, Strasskirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 585 days.

(21) Appl. No.: 13/547,961

(22) Filed: Jul. 12, 2012

(65) Prior Publication Data

US 2013/0174628 A1 Jul. 11, 2013

Related U.S. Application Data

(63) Continuation-in-part of application No. PCT/EP2011/053397, filed on Mar. 7, 2011.

(30) Foreign Application Priority Data

Mar. 8, 2010 (DE) ..... 10 2010 010 603

(51) Int. Cl.

| | |
|---|---|
| ***B21H 1/20*** | (2006.01) |
| ***B21B 23/00*** | (2006.01) |
| ***E02D 5/80*** | (2006.01) |
| ***E04H 12/22*** | (2006.01) |

(52) U.S. Cl.

CPC *B21B 23/00* (2013.01); *B21H 1/20* (2013.01); *E02D 5/801* (2013.01); *E04H 12/2223* (2013.01)

(58) Field of Classification Search

CPC ..... B21B 23/00; B21H 1/20; E04H 12/2223; E02D 5/801

USPC ..... 72/194, 224, 274, 278, 370.13, 370.24, 72/77, 78, 95, 100, 110

See application file for complete search history.

(56) References Cited

U.S. PATENT DOCUMENTS

| | | | | |
|---|---|---|---|---|
| 10,569 | A * | 2/1854 | Jackson | 72/224 |
| 14,551 | A * | 4/1856 | Brooks | 72/224 |
| 838,569 | A * | 12/1906 | Numan | 72/208 |
| 2,349,246 | A * | 5/1944 | Coe | B21C 37/18 72/187 |
| 2,882,851 | A * | 4/1959 | Graves | 72/85 |

(Continued)

FOREIGN PATENT DOCUMENTS

| | | |
|---|---|---|
| CN | 201338038 | 11/2009 |
| DE | 1 085 125 | 10/1957 |

(Continued)

*Primary Examiner* — Shelley Self
*Assistant Examiner* — Peter Iannuzzi
(74) *Attorney, Agent, or Firm* — Norris, McLaughlin & Marcus, P.A.

(57) ABSTRACT

The invention relates to a method and device for producing conical sections in cylindrical pipes of screw-in foundations by drawing. The device comprises a plurality of press rolling disks (segments) disposed radially about a longitudinal axis of a receptacle for the cylindrical pipe to drawn, pivotable about axes extending transverse and tangential to the longitudinal axis and designed such that the outer circumferential surfaces of the press roller disks (segments) form a developed cone. The device further comprises a drawing die for drawing the pipe along the longitudinal axis through the press roller disks (segments), such that the conical section can be formed by means of the outer circumferential surfaces rolling on the pipe during drawing. Spring elements clamp the press roller disks (segments) against the pipe. A rotary device rotates the pipe for uniform processing thereof.

21 Claims, 25 Drawing Sheets

(56) References Cited

U.S. PATENT DOCUMENTS

| | | | | | |
|---|---|---|---|---|---|
| 3,357,223 | A * | 12/1967 | Tremblay | 72/189 | |
| 3,688,540 | A * | 9/1972 | Russel | B21B 23/00 | 72/208 |
| 3,834,206 | A * | 9/1974 | Lamontagne | B21D 41/04 | 72/211 |
| 4,571,807 | A * | 2/1986 | Hines | B23P 19/02 | 29/252 |
| 5,315,854 | A * | 5/1994 | Ledebur | 72/297 | |
| 6,644,083 | B2 * | 11/2003 | Pakker | B21D 19/046 | 29/890.15 |
| 7,007,910 | B1 | 3/2006 | Krinner et al. | | |
| 2003/0221472 | A1 | 12/2003 | Lee et al. | | |

FOREIGN PATENT DOCUMENTS

| | | |
|---|---|---|
| EP | 1 105 597 | 6/2001 |
| WO | WO-93/21393 | 10/1993 |

* cited by examiner $$\alpha = \frac{360^\circ}{\text{number of rolls} \cdot 2}$$

METHOD AND DEVICE FOR PRODUCING CONICAL PIPE SECTIONS IN HELICAL FOUNDATIONS

REFERENCE TO RELATED APPLICATION

This is a Continuation-In-Part application of PCT/EP2011/053397 filed Mar. 7, 2011. The subject matter of the aforementioned prior application is hereby incorporated herein by reference.

BACKGROUND OF THE INVENTION

The invention relates to a method and to a device for producing tapering pipe sections on cylindrical pipes for ground screw foundations. Methods and devices for producing tapering, and more particularly conical sections on cylindrical, and notably metallic, pipes for the production of screw-in foundations used to mount components in the ground are known. The conical sections can be produced in a variety of ways, for example by welding together prefabricated shaped parts, or by hammering preferably seamless cylindrical pipes (see EP 1 105 597 B1). It is also possible to produce them by rolling preferably seamless pipes. The designs of the devices used for this purpose can thus vary accordingly.

However, the aforementioned methods are very complex. Production starting from prefabricated shaped parts, for example, requires a variety of steps (producing the shaped parts, for example by cutting, then bending and welding of the seams, and the like). Production processes based on hammering or rolling cylindrical pipes are not problematic as such, but are very complex in terms of the equipment that is required for the hammering or rolling device. The conventional hammering is associated with high wear and corresponding noise.

The objects are therefore to provide a method, by means of which such tapering sections can be produced on cylindrical pipes, or tapering sections can be produced from cylindrical pipes, for ground screw foundations in a simple and cost-effective manner, and to provide a device for carrying out such a method, which can be produced with reasonable complexity and which also allows for production of the ground screw foundations, which are economical and free of defects, requiring low personnel overhead. Tapering sections shall be considered to include all sections in which the cross-sectional shape or the diameter decreases. In pipes, a tapering section shall be considered to be in particular a section which is rotationally symmetrical relative to the longitudinal direction of the pipe, such as a conical section for example, which is to say a taper or a (truncated) cone, or a section having a curved, and more particularly a convex or concave, surface in the longitudinal direction of the pipe. Non-rotationally symmetrical sections, such as (truncated) cones having an elliptic base area or polygonal pyramids, and more particularly rectangular pyramids, are also tapering sections within the meaning of the invention.

SUMMARY OF THE INVENTION

According to the invention, the tapering pipe sections are produced by way of drawing preferably cylindrical, seamless pipes. The device according to the invention is used to carry out this method.

The deformation device comprises a working tool, which is composed of a variety of press roll disks or press roll disk segments. These are disposed radially around a longitudinal axis of a holder for the cylindrical pipe that is to be drawn. In addition, they are disposed pivotably around shafts which extend transversely and tangentially relative to the longitudinal axis of the holder and are designed so that, with development, the outer circumferential surfaces thereof form a tapering shape, preferably a cone.

The device moreover comprises a drawing unit. This unit is used to draw the pipe and/or the working tool along the longitudinal axis so that relative movement is achieved between the pipe and the working tool, which causes the shaping outer circumferential surfaces of the press roll disks, or press roll disk segments, to roll on the pipe and thus, through the cooperation thereof, transfer the tapering, and more particularly the conical or semi-conical shaping of the development to the pipe. By a corresponding selection of the development curve of the press roll disks or press roll disk segments, a tapering section can be produced which can be substantially freely selected in terms of the contour or geometry thereof.

This procedure has considerable advantages, in particular over the production of corresponding tapering pipe sections by way of rolling, which is likewise conceivable. In particular, this eliminates the complex drive is required for the rolling device. This is particularly important because a variety of press roll disks, or press roll disk segments, are provided in the device according to the patent. So as to produce the required synchronization of the speed of the press roll disks, or press roll disk segments, during rolling, each disk would have to be driven. However, this requires a complex gearboxes, which would be almost impossible to accommodate in the necessary dimensions, and in any case would be extremely complex and costly in terms of the design. However, when drawing is selected as the working method, a drive for the press roll disks, or press roll disk segments, is not necessary, which in itself results in considerable reductions in the complexity. In particular, a configuration comprising segments allows a particularly stable and compact construction.

The relative movement between the working tool and the pipe that is to be drawn can be generated in a variety of ways. The working tool can be held in a stationary manner, and the pipe can be drawn by means of the drawing unit. Alternatively, the pipe can be held in a stationary manner by means of a retaining unit, and the working tool can be drawn by means of the drawing unit. Finally, it is even possible to move both the pipe and the working tool toward each other in the relative movement.

So as to ensure uniformity of the cylinder shape which is created during drawing, and notably so as to minimize burrs between the individual press roll disk impressions on the workpiece, according to the invention, the pipe, or the working tool, can be further rotated about the longitudinal axis thereof (the longitudinal axis of the holder, or of the tube) during drawing. For this purpose, the retaining and drawing unit can also be designed as a rotating unit, or the working tool can be rotatable.

The rotation of the pipe, or of the working tool, does not have to be a rotation of 360° C. A rotation by an angle alpha=360°/number of rolls×2 suffices to ensure overlapping working of the seams between the press roll disk or of burrs forming on the workpiece, and the rotation can be carried out in steps or in an oscillating manner.

The device comprises one or more clamping units for clamping the pipe so as to be able to hold, draw and optionally rotate the pipe.

The clamping units can be designed to be self-locking so that, during drawing, the retaining force thereof increases proportionally to the tensile loads that are applied.

So as to prevent the pipe or pipes from diverting from the longitudinal axis of the holder during the drawing operation, the drawing device is advantageously equipped with a linear guide for guiding the pipe or pipes and/or the retaining, drawing and rotating unit and/or the working tool along the longitudinal axis of the holder.

So as to ensure that the outer circumferential surfaces of the press roll disks, or press roll disk segments, are carried along in a shaping manner during drawing, they must be seated with a friction fit against the pipe that is to be drawn at the start of the drawing operation. For this purpose, the press roll disks, or press roll disk segments, are preloaded by at least one spring element, so that they are seated with friction fit under tension against the pipe inserted into the holder. This is achieved according to the invention as follows:

The press roll disks, or press roll disk segments, are preloaded by the at least one spring element so that they are in the position of the smallest cross-section of the development thereof. When a pipe, for the purpose of working the same, is inserted into the holder defined by the outer circumferential surfaces of the press roll disks, or press roll disk segments, it impinges on this smallest cross-section of the development. In the course of further insertion of the pipe into the working position, it pushes the press roll disks, or press roll disk segments, back against the force of the at least one spring element in the direction of the position of the largest cross-section (or the cross-section corresponding to the pipe cross-section) of the development of the outer circumferential surfaces of the disks or disk segments, this being the position in which working of the pipe starts, as a result of drawing the same in the opposite direction.

The spring element ensures, or the spring elements ensure, by way of the restoring force thereof directed in the working direction, not only that the plurality of outer circumferential surfaces of the press roll disks, or press roll disk segments, are in uniform contact against the pipe, but also that they support the drawing process with this force, to a certain degree.

It is, of course, also conceivable to design the device so that the cylindrical pipe is inserted into the device in the same direction in which it is drawn out during the work. This would have the advantage of avoiding reversing the direction between insertion and drawing of the pipe. However, the press roll disks, or press roll disk segments, would then have to be in an open position for insertion of the pipe, because otherwise the pipe could not be inserted. This precludes the option of holding the press rolls disks, or press roll disk segments, under preload during insertion of the pipe. So as to ensure that the press roll disks, or press roll disk segments, are carried along during drawing, the corresponding preload must be established after the pipe is inserted and the position in which working is to begin is reached. This solution thus requires a higher design complexity than the one described before.

The spring element can be, among other things, at least one gas spring or a controlled pneumatic cylinder.

While the spring elements, through the restoring force thereof, do to some extent ensure a uniform, synchronous development of the outer circumferential surfaces of the press roll disks, or press roll disk segments, on the pipe, and thus a desired accurate transfer of the size of the development to the pipe, it is nonetheless advisable that this be further ensured this by way of synchronized coupling of the press roll disks, or press roll disk segments.

According to the invention, this is done by providing toothing on the disks or disk segments. This toothing can, for example, be positioned in the vicinity of the outer circumferential edges. The coupling attained is thus not very complex in terms of the design, and notably is very direct, with little friction loss.

According to the invention, at least 18, preferably 24, and still more preferably 28, 32 or 36 press roll disks, or press roll disk segments, are provided. This large number of disks ensures exact, uniform working of the workpiece.

The key here is to avoid the formation of burrs on the taper to be formed. The outer circumferential surfaces of the press roll disks, or press roll disk segments, must thus seamlessly join one another in the development thereof. So as to ensure this, the disk edges are radially chamfered.

In order that the outer circumferential surfaces of the disks, or disk segments, form a taper that diminishes opposite to the working direction, in the development thereof, the surfaces must be tapered toward the cone point. In light of the large number of press roll disks, or press roll disk segments, which are provided according to the invention, they could potentially become so narrow toward the cone point that the stability which is required to absorb the high deformation pressures would be jeopardized. So as to counteract this, according to the invention, the number of disks involved in the deformation is decreased over the course of the deformation process toward increasingly smaller pipe diameters. This is assured by designing individual or groups of press roll disks, or press roll disk segments, so as to be radially disengageable in relation to the remaining press roll disks, or press roll disk segments, during the drawing of the pipe.

The press roll disks, or press roll disk segments, can be replaceable with disk sets having a different size, so as to produce tapering sections on cylindrical pipes having differing cross-sections using a drawing unit according to the invention.

This application is based on the assumption that a tapering section is normally produced in a single drawing operation. However, this may cause the device to reach the limits of the load capacity thereof, notably with particularly strong cylindrical pipes or with particularly strong deformations (high gradients of the tapering section to be formed). For such cases, according to the invention, the drawing unit is designed for multi-stage or multi-step drawing operations. This means that the desired shape, for example a cone, is not produced in one operation, but rather, in a first step, the pipe is initially inserted into the holder only over a portion of the section of the intended tapering deformation, and is drawn so that only a deformation smaller than the one which is ultimately intended is initially reached, and the pipe, in one or several further steps, is then inserted a little deeper into the holder each time, and is drawn until the desired net shape, for example a cone, has been produced.

Considering the manner of the configuration of the outer circumferential surfaces of the press roll disks, or press roll disk segments, the formation of burrs on the tapering section should be precluded, or should remain within a reasonable scope, because the outer circumferential surfaces seamlessly adjoin each other in the development, and therefore no room should exist for formation of burrs. In order to further ensure this, for example if the seamless adjoining of the outer circumferential surfaces should be adversely impacted, for example due to tool wear or other tolerances, and moreover in order to achieve uniformity of the outer contour in any case, a rotating unit may be further provided for rotating the pipe and/or the working tool around the longitudinal axis of the holder during the drawing operation, or between the multiple drawing steps of a multi-step drawing operation.

The invention further relates to a method for producing tapering sections on cylindrical pipes for ground screw foundations by way of drawing, by means of the hereinabove described device.

This method can, for example, also be designed so that the drawing operation is carried out in several stages or steps (multi-step). This is done by inserting the cylindrical pipe only part-way into the holder for the first drawing stage, then drawing it, and subsequently inserting it a little further into the holder for a second drawing stage, then drawing it, and finally, for example in a third drawing stage, inserting it entirely into the holder, then drawing it, so that in this step the outer circumferential surfaces of the press roll disks, or press roll disk segments, roll entirely on the pipe and completely transfer the shape of the development thereof to the pipe. For this purpose, a drawing unit which allows such multi-step drawing is to be provided.

The method may include rotating the pipe around the longitudinal axis thereof during drawing and/or between several consecutive drawing steps, for example in order to avoid the formation of burrs or so as to compensate for inaccuracies in the tapering section to be formed. The rotating device is provided for this purpose.

The method can further be designed so that the several drawing steps are applied consecutively, at differing points on the length of the cylindrical pipe, so as to generate several tapering sections having differing cross-sections and/or differing gradients on a cylindrical pipe. For this purpose, the drawing unit must support such a multi-step drawing operation, for example by way of adjustable cooperation between the drawing device and deformation unit, in such a manner that either several deformation units are arranged consecutively and the individual deformation units have different sets of press roll disks, or press roll disk segments, respectively, and the drawing unit feeds the pipe that is to be deformed to the respective deformation unit, or the drawing unit, and the press roll disks or segments cooperate so that the pipe that is to be deformed is consecutively fed to the regions of the press roll disks, or press roll disk segments, which correspond to the respective degree of deformation to be achieved.

The method for generating several tapering sections of differing cross-sections and/or differing gradients on a cylindrical pipe is thus also carried out with different sets of press roll disks, or press roll disk segments. For this purpose, it must be possible to replace sets of press roll disks, or press roll disk segments, of differing sizes between each other, unless a dedicated drawing unit is to be used for each size.

The invention further relates to a method of the type mentioned above for generating several tapering sections having differing cross-sections and/or differing gradients on cylindrical pipes of ground screw foundations, in which a first tapering section is produced on a pipe having a smaller pipe cross-section by means of a device according to the patent, and then a tapering section is produced on a cylindrical pipe having a larger pipe cross-section by means of a device according to the invention, wherein a cylindrical end region of the cylindrical pipe having the smaller pipe cross-section is introduced, into the end region of the cylindrical pipe having the larger cross-section that is to be deformed in a tapering manner, before or during the production of the tapering section on the cylindrical pipe having the larger cross-section, and is fixed there during the tapering deformation.

The invention moreover relates to a method of the type mentioned above, in which one of the end regions of a cylindrical pipe having a smaller pipe cross-section is introduced into the end region of cylindrical pipe having a larger cross-section that is to be deformed in a tapering manner, before or during the production of the tapering section on the cylindrical pipe having a larger cross-section, and is fixed there with press fitting during the tapering deformation of this end region, so as to generate a ground screw foundation from cylindrical pipes having differing cross-sections and at least one tapering section.

Lastly, the invention also relates to a ground screw foundation comprising at least one cylindrical pipe having at least one tapering section, produced by one of the aforementioned methods. A tapering section designed as a cone may have a constant cone angle, or several, different cone angles.

Using the drawing method according to the invention, ground screw foundations having tapering sections notably in the longitudinal direction of the ground screw foundation can be produced. In the production method according to the invention, the curve shape of the press roll disks, which is to say the development contour of the press roll disks, defines the engagement in the radial direction. The geometry of the ground screw foundation can thus be adapted to the respective application of the ground screw foundation by appropriately selecting the curve shape of every curve disk, which can essentially be freely selected.

The transitions between different tubular and tapering sections, and more particularly between the conical and cylindrical sections of the ground screw foundation, can be convexly or concavely tapering transition regions, or an edge or a bend. The lateral region of the ground screw foundation preferably transitions continuously, which is to say substantially without an edge, from a tubular or conical section into a convex or concave region. Both the convexity radius R and the concavity radius r of the tapering transition regions can be designed to be constant or variable. It is obvious to a person skilled in the art that, because of the technical circumstances, an edge will always have a certain small radius.

The different tubular and tapering sections and the transition regions can be combined in any arbitrary form for this purpose. In particular an S shape can be formed, in which a first tubular section transitions via a cone into a second tubular section. The transition regions between the cone and the tubular sections preferably have a concave or convex design. The length of the concave section may be designed infinitesimally smaller, so that the convex section transitions into a concave section in a reversal line extending around the ground screw foundation.

A ground screw foundation according to the invention has a single- or multi-piece design, and more particularly a two-piece design. In the case of a multi-piece design, the ground screw foundation preferably comprises several cylindrical sections, and the individual elements of the ground screw foundation are joined during the production method according to the invention by way of a press-fit connection, notably in a cylindrical section of the pipes.

In a further method step, this basic shape of a ground screw foundation can subsequently be provided with a screw helix and/or a tip. The tip can, for example, be produced by obliquely severing the lower end of the ground screw foundation or by way of forging. The screw helix is often welded to the basic shape.

BRIEF DESCRIPTION OF THE DRAWINGS

The invention will now be described in more detail based on the drawings. In the drawings.

DETAILED DESCRIPTION OF THE INVENTION

Figure 1:
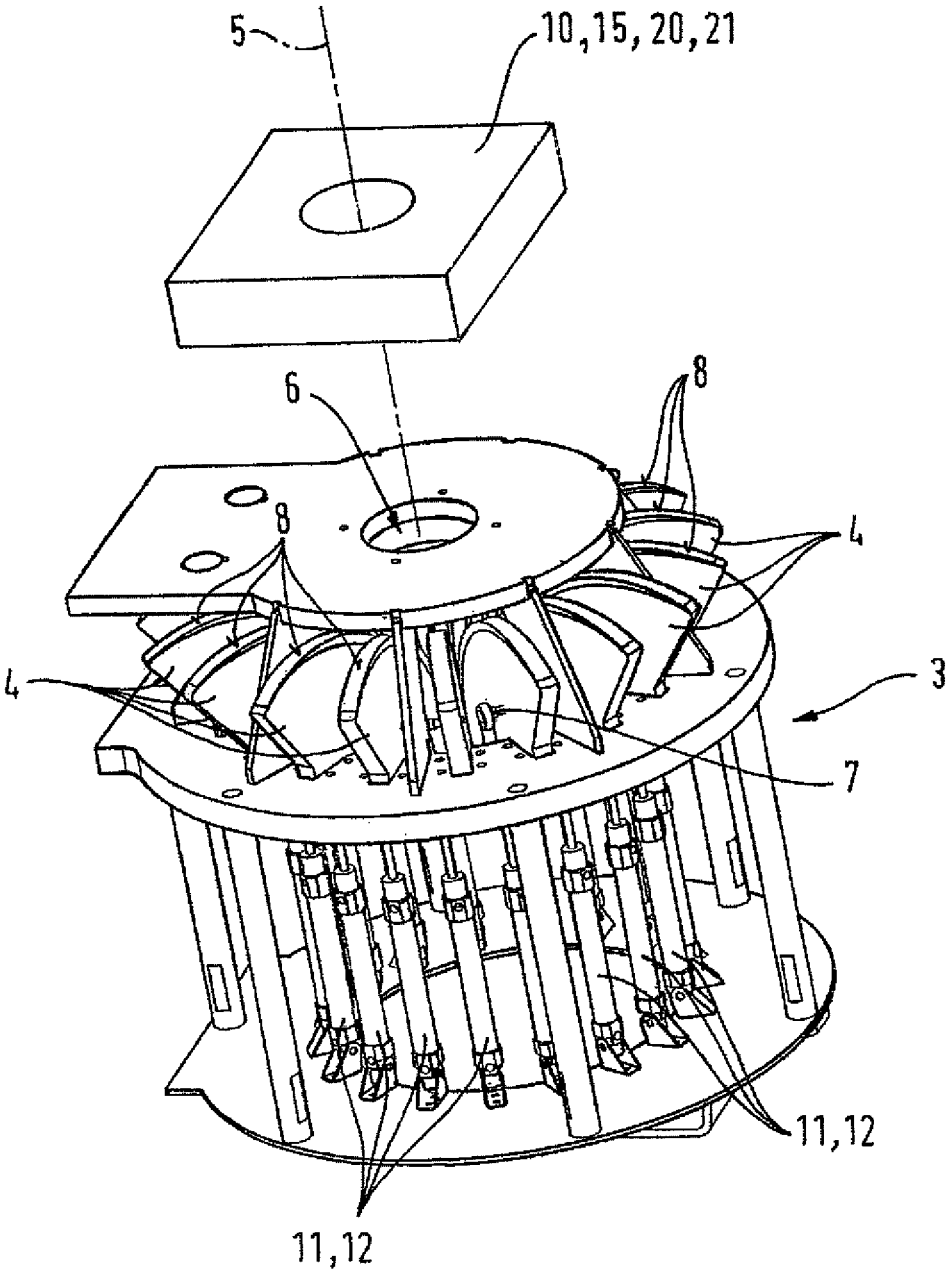
FIG. 1: shows a perspective view of the device according to the invention for producing conical sections 1 on cylindrical pipes 2 of ground screw foundations by way of drawing.

FIG. 1 shows the device according to the invention for producing at least one conical section (1) on cylindrical pipes (2) of ground screw foundations by way of drawing. The device comprises a plurality of press roll disks or press roll disk segments (4), which are disposed radially around a longitudinal axis (5) of a holder (6) for the cylindrical pipe (2) that is to be drawn, and pivotably around shafts (7) extending transversely and tangentially relative to the longitudinal axis (5), and which are designed so that, with development, the outer circumferential surfaces (8) of the press roll disks or press roll disk segments (3) form a cone.

Also shown are spring elements (11) in the form of gas springs (12), by means of which the press roll disks or press roll disk segments (4) are preloaded.

In addition, a unit (10) for drawing and/or for rotating (15) the pipe (2) is shown, by means of which the pipe (2) can be drawn along the longitudinal axis (5) through the press roll disks or press roll disk segments (4), so that the conical section (1) can be formed by means of the outer circumferential surfaces (8) rolling on the pipe during drawing.

Figure 2:
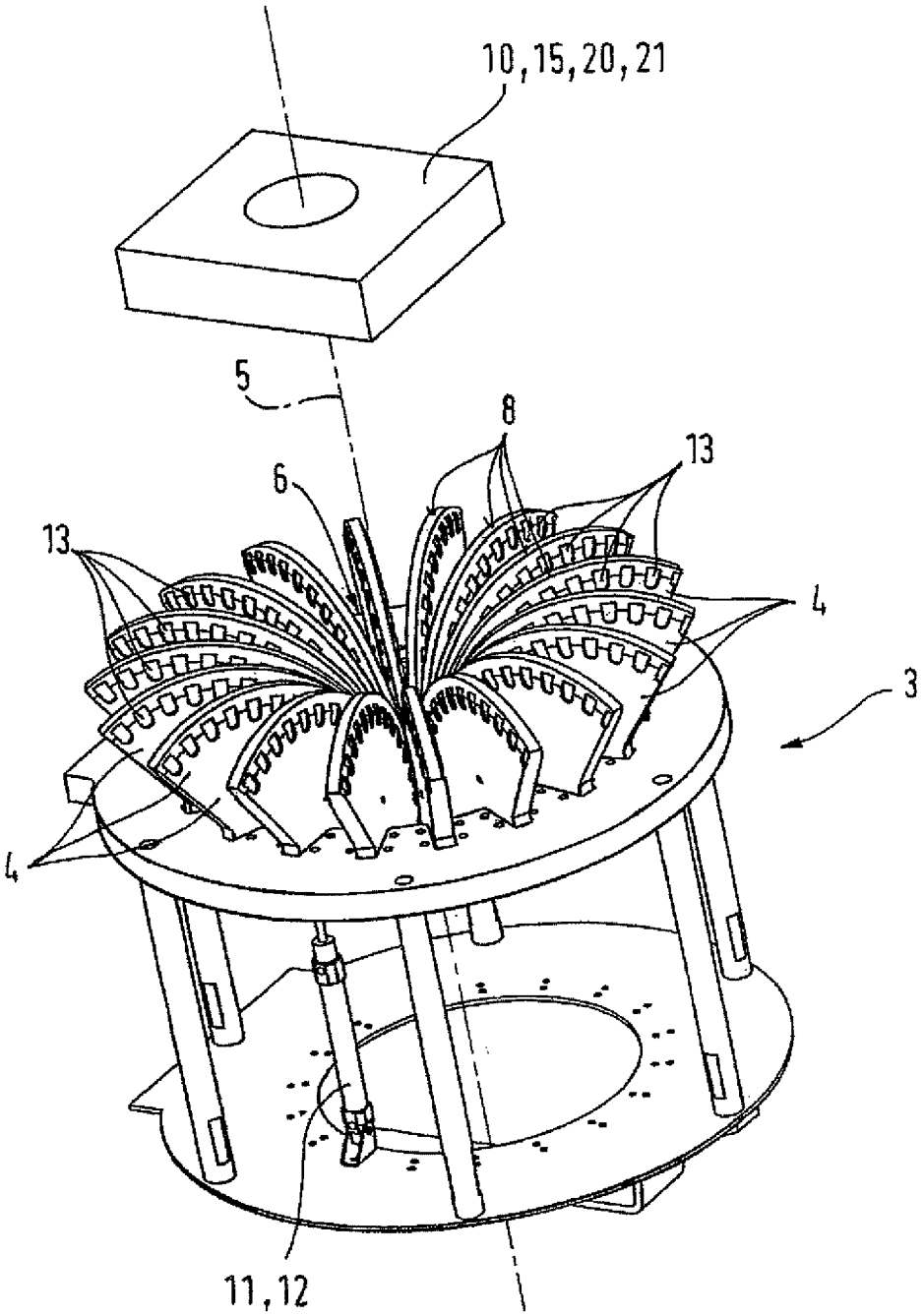
FIG. 2: is a different perspective view of the device according to the invention.

FIG. 2 shows a different perspective view of the device according to the invention of FIG. 1. It differs from the representation of FIG. 1 in that only a single element (11, 12) is shown in the place of the several spring elements (11) in the form of gas springs (12). Moreover, the toothing (13) is shown here, by means of which the press roll disk segments (4) are synchronously coupled to each other.

Figure 2A:
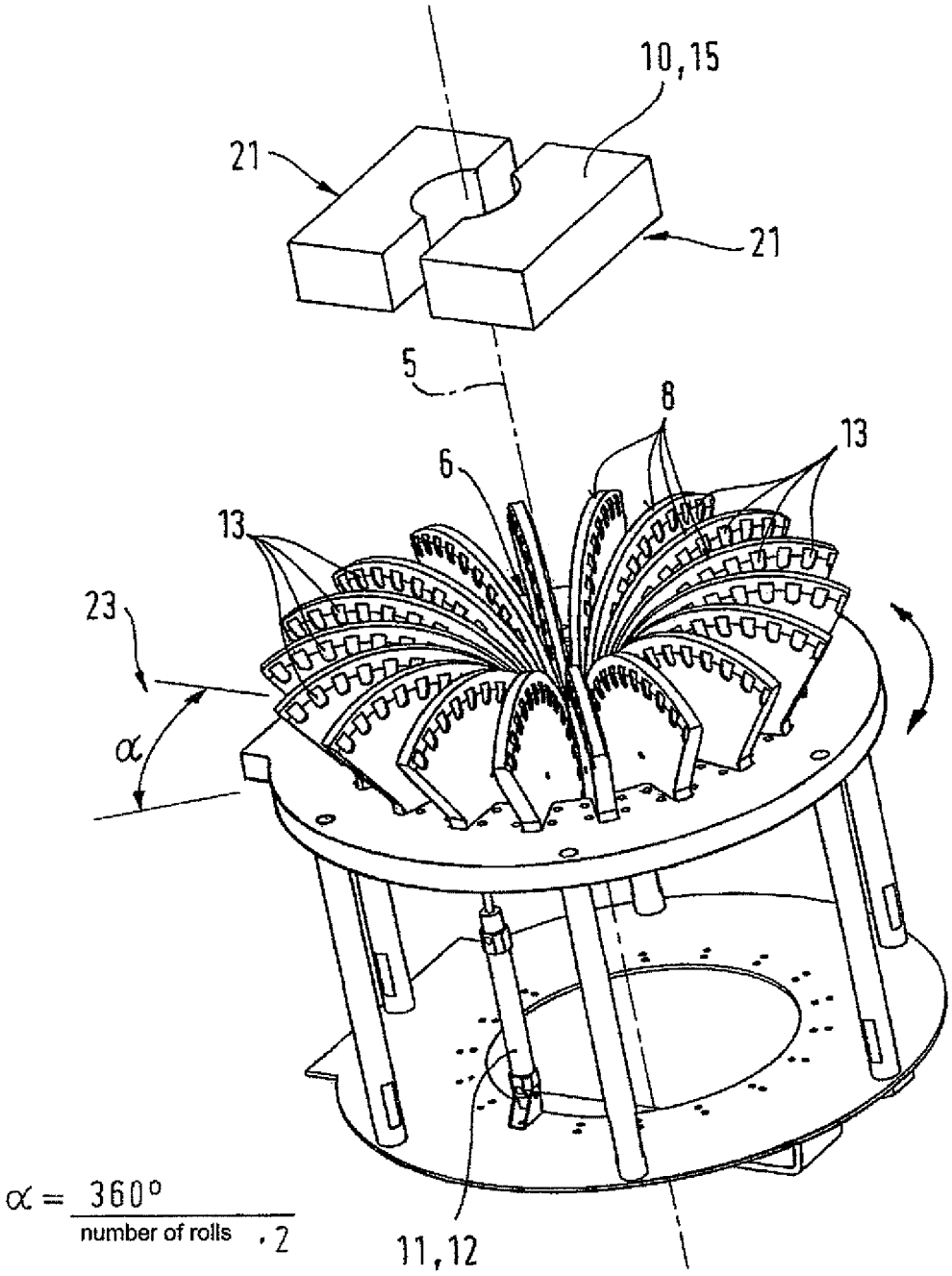
FIG. 2*a*: is a different perspective view of the device according to the invention in which, in particular, the clamping unit (21) of the drawing and rotating unit (19, 15) and the angle of rotation of the drawing unit are shown in more detail.

FIG. 2*a* is a different perspective view of the device according to the invention of FIG. 2, in which, in particular, the clamping unit (21) of the drawing and rotating unit (10, 15) and the angle of rotation (23) of the drawing unit (15) are shown in more detail. In accordance with the formula alpha=360°/number of rolls×2, this angle of rotation (23) is established so as to allow for working burrs, which may be created between the effective regions of the press roll disks or press roll disk segments (4), at the smallest angle of rotation possible.

Figure 3:
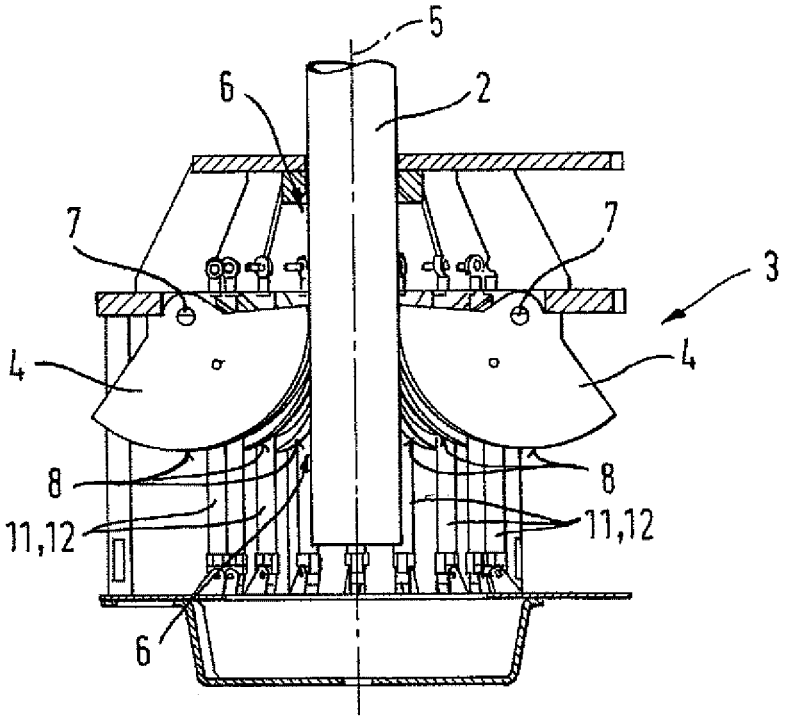
FIG. 3: is a sectional view of the device according to the invention of FIGS. 1 and 2, showing the cylindrical pipe 2 inserted into the holder 6 for working purposes.

FIG. 3 shows a sectional view of the device according to the invention of FIGS. 1 and 2, comprising press roll disk segments (4) which are disposed radially around a longitudinal axis (5) of a holder (6) for the cylindrical pipe (2) that is to be drawn, and pivotably around shafts (7) extending transversely and tangentially relative to the longitudinal axis (5), and which are designed so that, with development, the outer circumferential surfaces (8) of the disk segments (3) form a cone.

Also shown are spring elements (11) in the form of gas springs (12), by means of which the disks or disk segments (4) are preloaded.

In addition, the cylindrical pipe (2) that is to be worked and inserted into the holder (6) is shown in the position at the start of the working operation by way of drawing.

Figure 4:
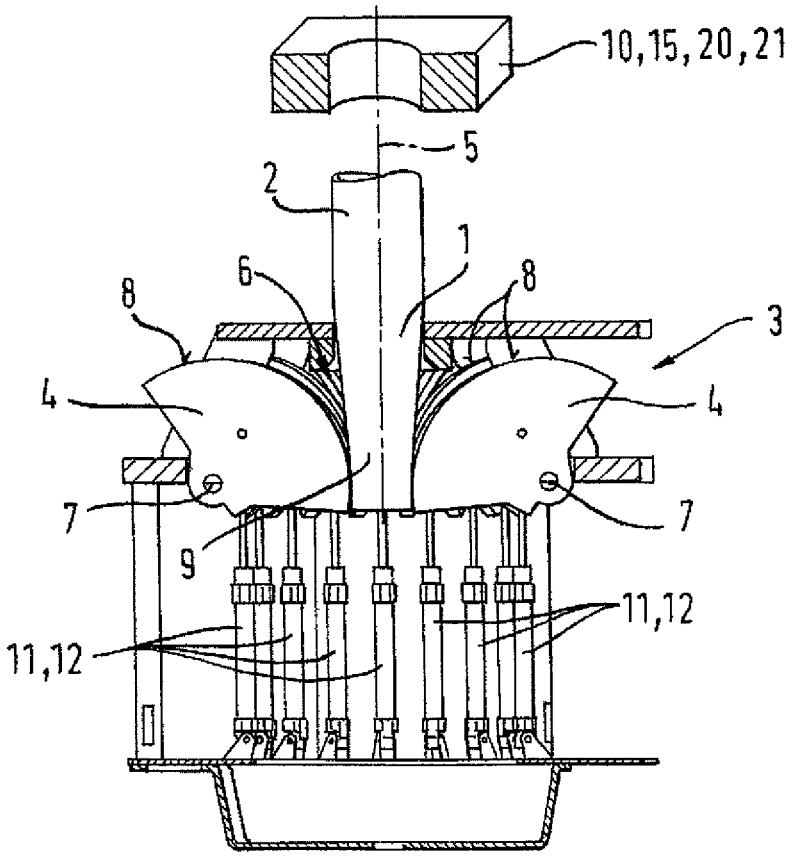
FIG. 4: is a sectional view of the device according to the invention of FIGS. 1 and 2, showing the end phase of the conical working of the cylindrical pipe 2.

FIG. 4 shows a sectional view of the device according to the invention of FIGS. 1, 2 and 3, comprising press roll disk segments (4) which are disposed radially around a longitudinal axis (5) of a holder (6) for the cylindrical pipe (2) that is to be drawn, and pivotably around shafts (7) extending transversely and tangentially relative to the longitudinal axis (5), and which are designed so that, with development, the outer circumferential surfaces (8) of the disk segments (3) form a cone.

Also shown are spring elements (11) in the form of gas springs (12), by means of which the disks or disk segments (4) are preloaded in accordance with the representation or the method step according to FIG. 3.

In addition, the cylindrical pipe (2) that is to be worked and inserted into the holder (6) is shown in the position of the final phase of the working operation by way of drawing, which is to say having an already shaped conical section (1) in the form of a cone (9).

In addition, a unit (10) for drawing and rotating (15) the pipe (2) is shown cut in half, and by these means the pipe (2) was drawn along the longitudinal axis 5 through the press roll disk segments (4) so that the conical section (1) was formed by means of the outer circumferential surfaces (8) rolling on the pipe (2) during drawing.

Figure 5:
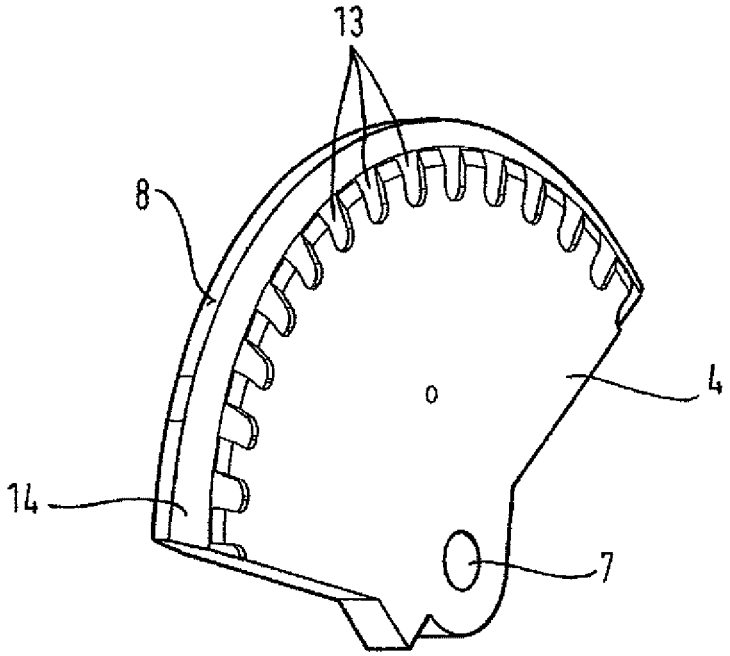
FIG. 5: is the perspective view of a press roll disk segment 3.

FIG. 5 shows a perspective view of a press roll disk segment (4). It shows the shaft (7) of the segment and the outer circumferential surface (8) thereof, and moreover the toothing (13) in the edge region (14) of the disk (4). In addition, the chamfer is visible, which is used to ensure that the press roll disk segments (4), when installed, are clear of each other during development, while the pipe section (2) is deformed into the cone (9), and adjoin each other as seamlessly as possible so as to achieve a cone surface that is uniformly deformed and clean to as great an extent as possible.

Figure 6:
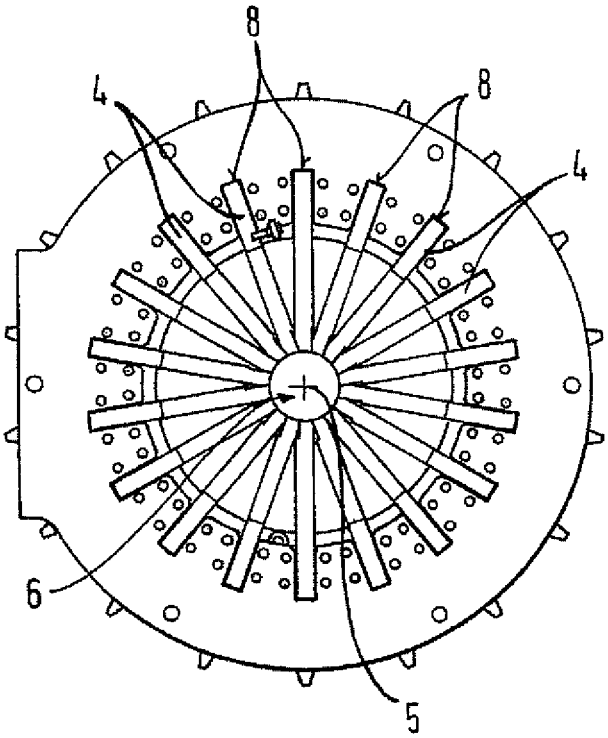
FIG. 6: is a sectional view of the device according to the invention.

FIG. 6 shows a top view of the device according to the invention. The press roll disk segments (4) and the outer circumferential surfaces (8) thereof can be seen. Also shown is the holder (6) for the pipe (2) that is to be worked and the longitudinal axis (5). Fastening bores for holding lugs for preload elements (11, 12) for the disks or disk segments (4) are likewise shown.

Figure 7:
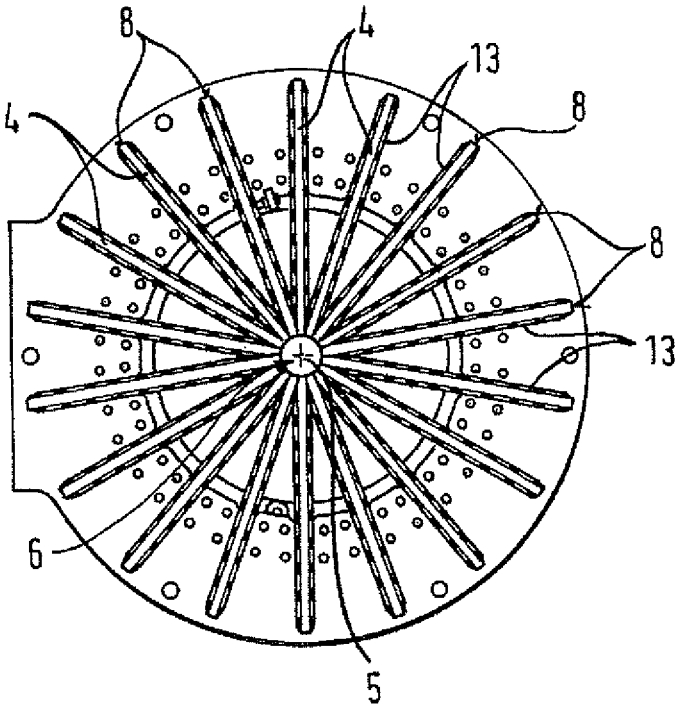
FIG. 7: is a top view of the device according to the invention comprising the press roll disks or press roll disk segments 3.

FIG. 7 shows a top view of the device according to the invention. The press roll disk segments (4) and the outer circumferential surfaces (8) thereof can be seen. Also shown is the holder (6) for the pipe that is to be worked and the longitudinal axis (5). The toothing (13) of the press roll disk segments (4) provided at the disk edges (14) is also indicated. The thickness of the disks or disk segments (4) is such that, not only can the high deformation forces be transmitted, but the disks (4) are only just clear of each other at the smallest cone diameter, yet are seated against the cone surface over almost the entire circumferences thereof.

Figure 8A:
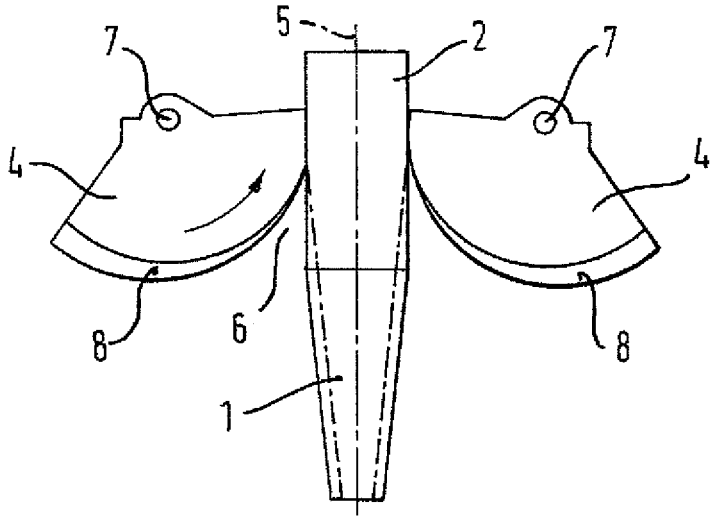
FIGS. 8 *a* to *c*: show three phases of the process of conically deforming a cylindrical pipe 2.
Figure 8B:
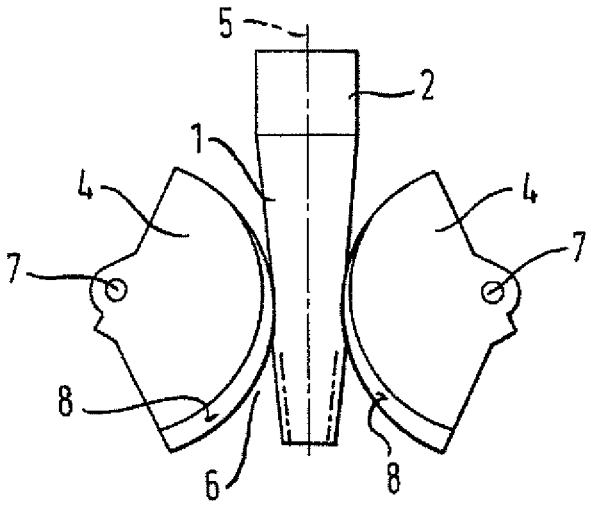
Figure 8C:
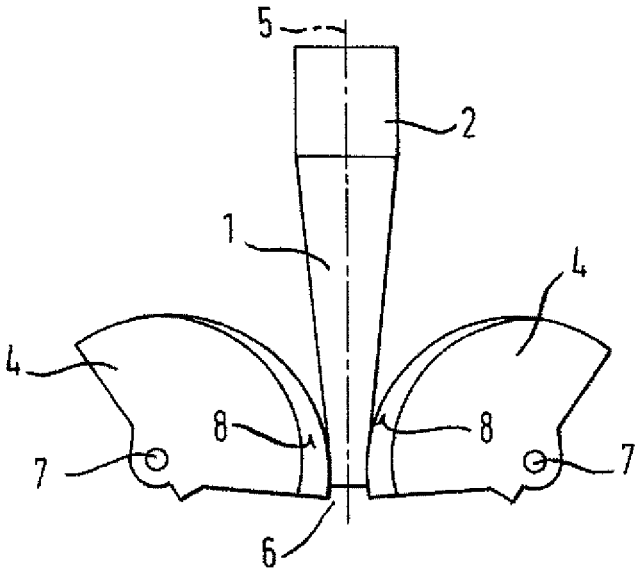

FIGS. 8 *a* to *c* show the process of conically deforming a cylindrical pipe (2) in three phases. The cylindrical pipe (2) here has already been provided with a conical section (1) (in an earlier operation). FIGS. 8 *a* to *c* show the process of further conically deforming the conical section (1) in three steps.

In FIG. 8*a*, the pipe (2) that is to be deformed is inserted into the device so far that the smallest radius of press roll disk segments (4) comes in contact with the surface of the pipe (2) that is to be deformed, at exactly the point at which further deformation into a longer cone section (1) on the pipe (2) starts.

FIG. 8 *b* shows that the process for the further conification has already been half way completed. The final cone (1) that is to be attained is indicated by the dash-dotted line. And finally, FIG. 8 *c* shows the state of conification in which the smallest conification diameter has been reached by way of the press roll disk segments (4) that formed this region of the smallest cone diameter, with the largest radii of press roll disk segments (4) located opposite each other.

FIGS. 9 *a* to *c* show three phases of producing a ground screw foundation having two conical sections (1) from cylindrical pipes (2) having differing cross-sections (16, 17).

The figures show a cylindrical pipe (2) having a larger cross-section (17), which was introduced into the holder in the longitudinal axis (5) of the holder (6).

Also shown is a further cylindrical pipe (2) having a smaller pipe cross-section (16) and a conical section (1), the cylindrical end region (18) of the pipe being axially aligned with the end region (19) of the pipe having the larger cross-section (17), which is to be conically deformed, for the purpose of being introduced into this second end region.

Also shown are press roll disk elements (4), which are mounted pivotably on shafts (7), and the outer circumferential surfaces (8) thereof for generating a conical section 1 at the end region (19) of the pipe (2) having the larger pipe cross-section (17) which is to be conically deformed.

Figure 9A:
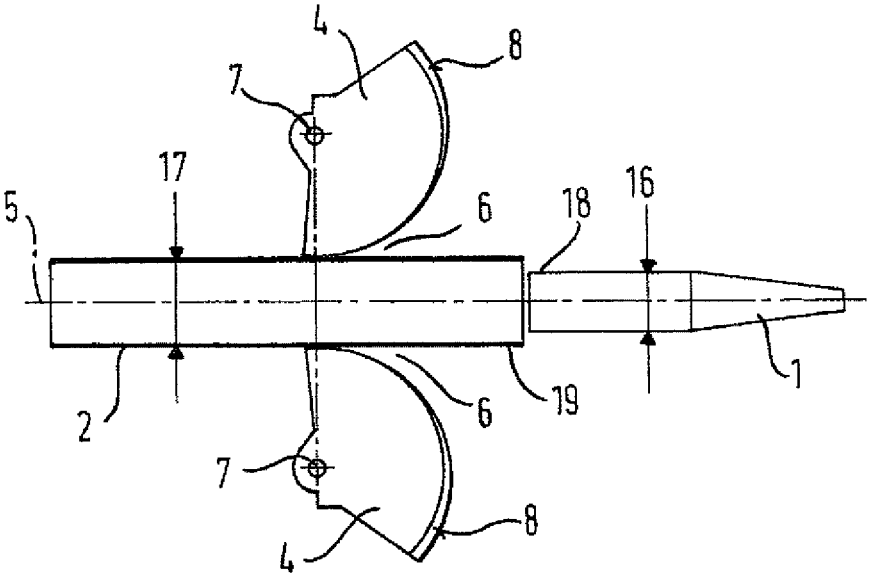
FIGS. 9 *a* to *c*: show three phases of the process of conically deforming a cylindrical pipe 2 having a larger cross-section 17, and having an end region 19 that is to be conically deformed, into which the cylindrical end region 18 of a cylindrical pipe 2 which has a smaller cross-section and is provided with a conical section 1 is introduced and fixed, by way of press fitting, during the conical deformation of the pipe having the larger cross-section.

FIG. 9*a* shows the device after inserting the cylindrical pipe (2) having the larger pipe cross-section (17), with the longitudinal axis (5) thereof in the holder (6). The pipe (2) and the press roll disk segments (4) are located in the open position, which is the position in which the working of the end region (19) which is to be conically deformed is to start, by way of drawing out the pipe (2) and roll-like rolling of the outer circumferential surfaces (8) of the press roll disk segments (4). The cylindrical end region (18) of the pipe (16) having the smaller pipe cross-section has not yet been introduced into the end region (19) of the pipe (17) having the larger pipe cross-section which is to be conically deformed.

Figure 9B:
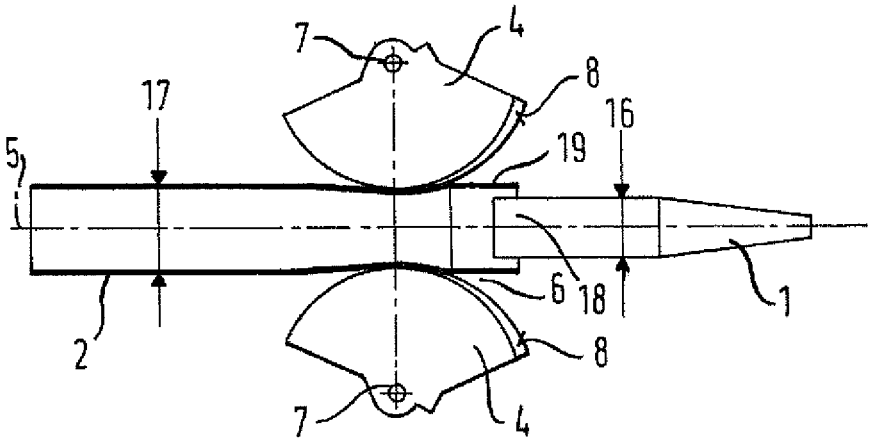

FIG. 9*b* shows the same device after insertion of the cylindrical end region (18) of the pipe (2) having the smaller pipe cross-section (16) into the end region (19) of the pipe (2) having the larger pipe cross-section (17), which is to be conically deformed. The cylindrical pipe (2) having the larger cross-section (17) in this illustration has already been drawn approximately half way. The deformation of the end region (19) of the pipe (2) having the larger pipe cross-section (17) which is to be conically deformed has already been partially completed.

Figure 9C:
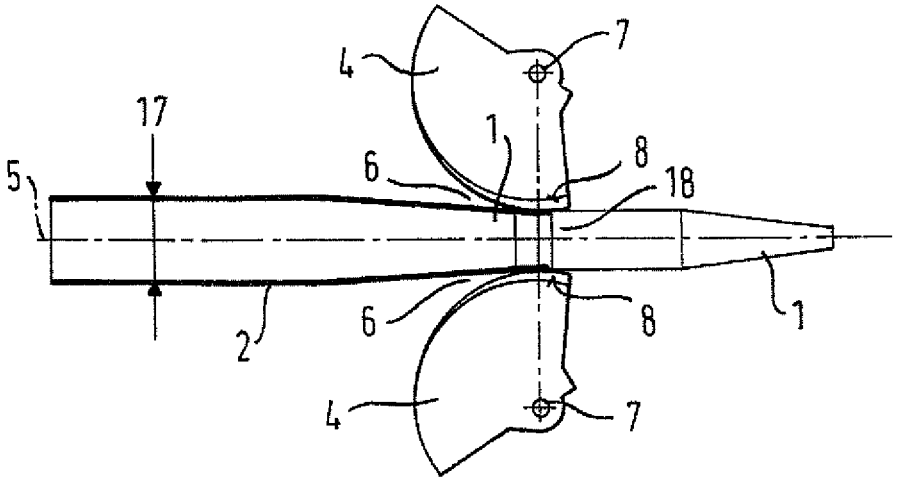

FIG. 9*c* shows the state at the end of the drawing and deformation process. The deformation of the end region (19) that is to be conically deformed is completed. The portion of the pipe (2) having the smaller cross-section (16), which has been inserted into the end region (19) of the pipe (2) having the larger cross-section (17), which is to be conically deformed, is fixed there by press fitting as a result of the conical deformation of the latter.

Figure 10A:
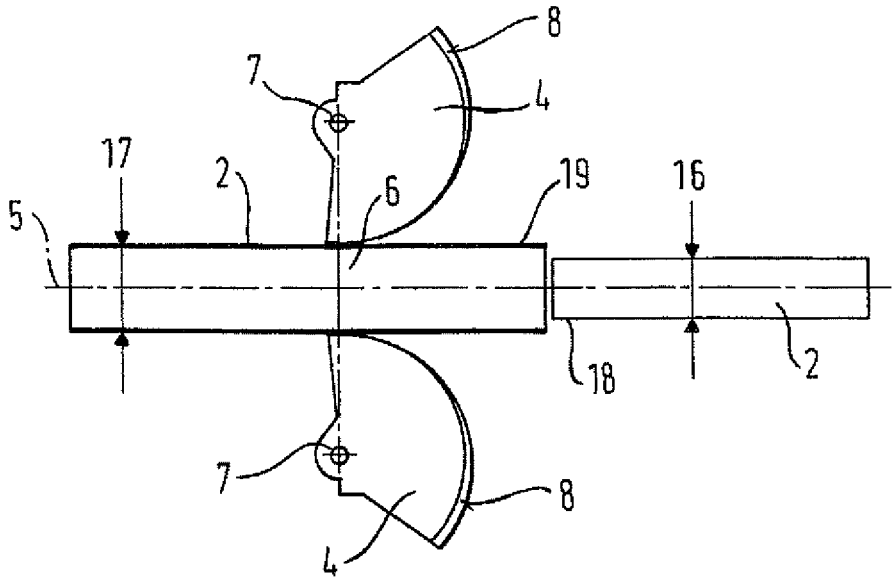
FIGS. 10 *a* to *c*: show three phases of the process of conically deforming a cylindrical pipe 2 having a larger cross-section 17, and having an end region 19 that is to be conically deformed, into which one of the end regions of a cylindrical pipe 2 having a smaller cross-section 16 is introduced and fixed, by way of press fitting, during the conical deformation of the pipe having the larger cross-section 17.
Figure 10B:
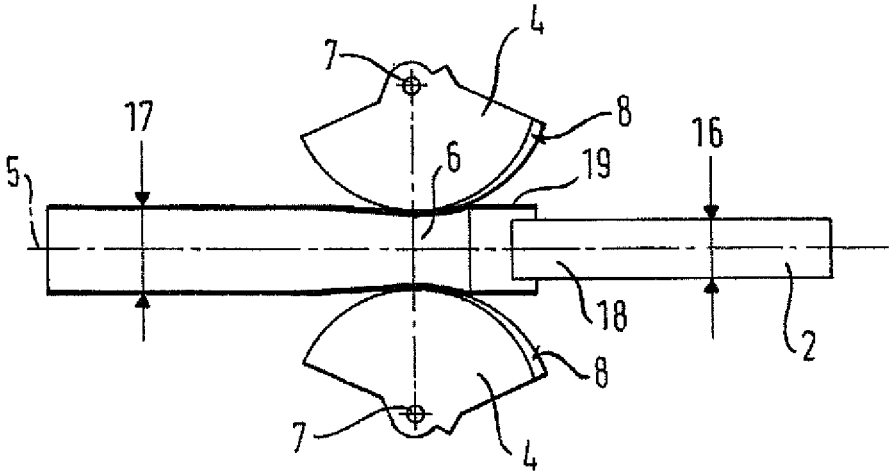
Figure 10C:
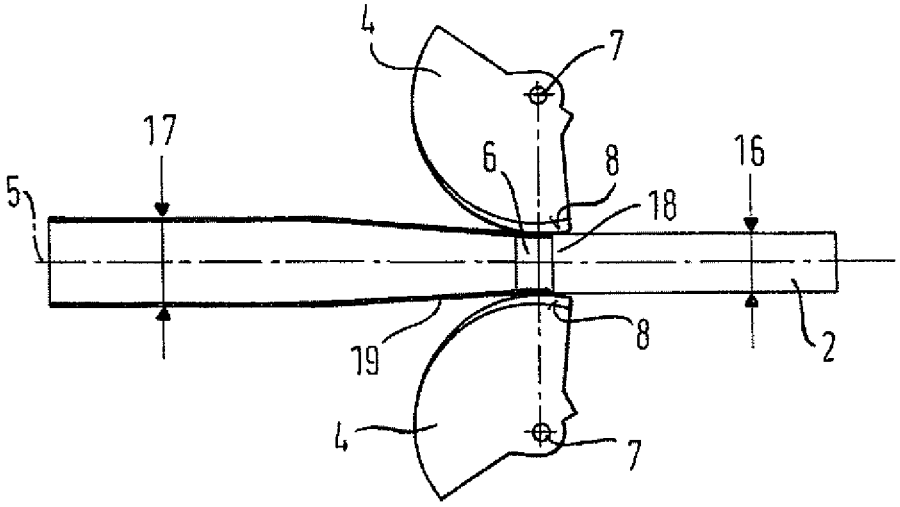

FIGS. 10 *a* to *c* show the same device and the same working steps of deforming an end region (19) of a cylindrical pipe (2) having a larger cross-section (17) and of integrally connecting a cylindrical pipe (2) having a smaller cross-section (16), the cylindrical end region 18 of which is introduced into the end region of the pipe (2) having the larger cross-section (17) which is to be conically deformed, and is fixed there with press fitting during the conical deformation of the end region 19 of the pipe having the larger cross-section 17 which is to be conically deformed, as is shown and described for FIGS. 9*a* to *c*.

Thus, FIGS. 10 *a* to *c* differ from FIGS. 9 *a* to *c* only in that the cylindrical pipe (2) having the smaller cross-section (16) does not have a conical section (1), but instead has a substantially undeformed cylindrical shape. Substantially undeformed shall mean that a certain degree of deformation of the cylindrical pipe (2) having the smaller pipe cross-section (16) is produced only in the connecting region, in which the two pipe parts were formed together or pressed together with press fitting.

Figure 11:
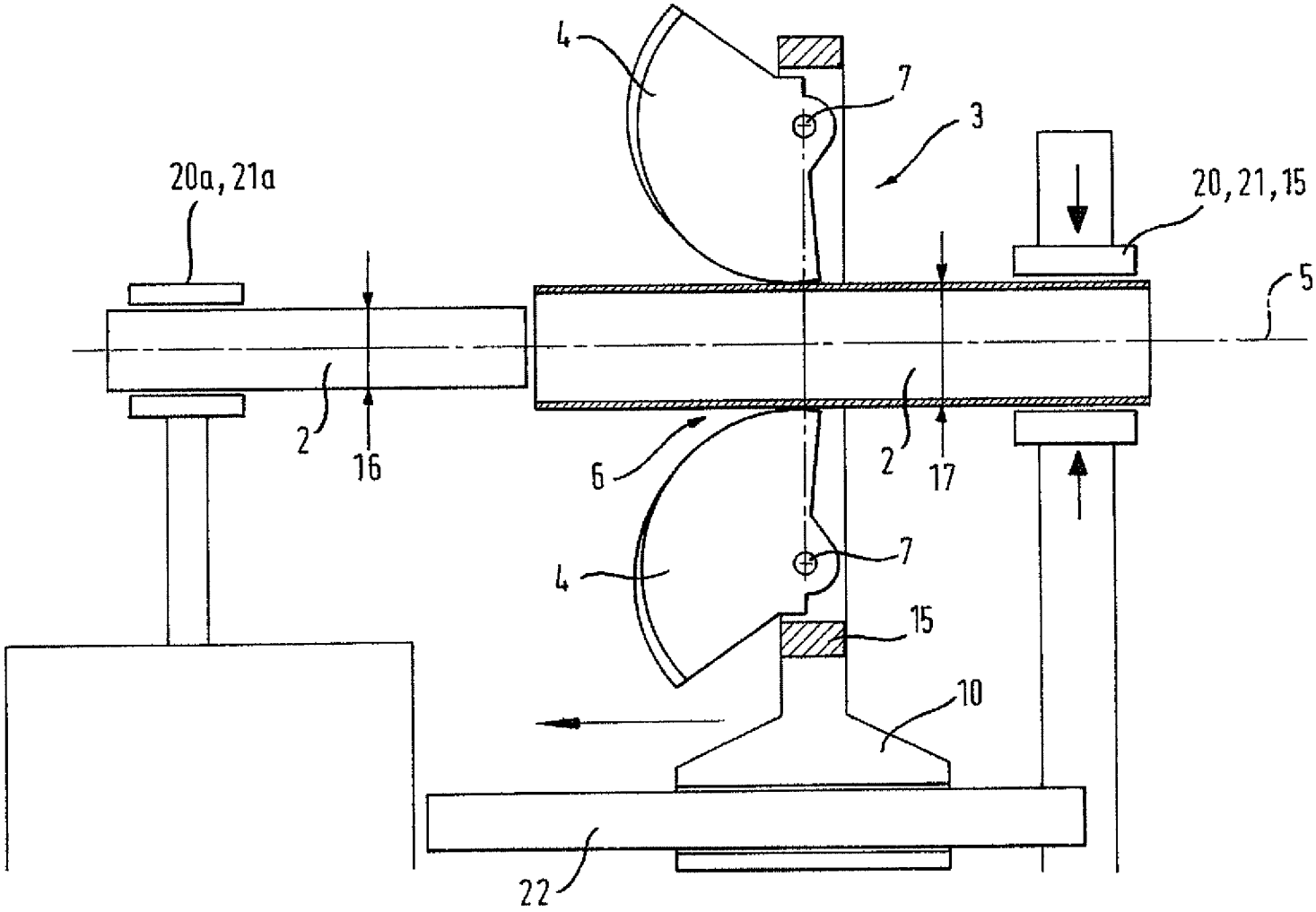
FIG. 11: shows the device according to the invention, comprising a working tool (3), a retaining unit (20) for the pipe (2) that is to be worked, and a drawing and rotating unit (10, 15) having a linear guide (22) for the working tool (3) and/or the retaining unit (20) as well as a further retaining unit (20*a*) for a cylindrical pipe (2) having a smaller pipe cross-section (16), which can be introduced into the end region (19) of the pipe (2) having the larger cross-section (17) that is to be deformed, so as to be fixed on this pipe.

FIG. 11 shows a device according to the invention comprising a working tool (3) composed of press roll disk segments (4), which are arranged around the longitudinal axis (5) of the holder (6) on shafts (7). A cylindrical pipe (2) having a larger pipe cross-section (17) is located in the holder (6) in longitudinal alignment with the longitudinal axis (5) of the holder (6). The pipe is inserted into the holder (6) so far that the press roll disk segments (7) are in the largest open positions thereof, and are seated against the pipe for the conical deformation thereof. The pipe (2) is held in a stationary manner and in the longitudinal axis (5) of the holder (6) by a retaining unit (20), by means of a clamping unit (21), and potentially also rotated by the rotating unit (15) during working, and/or drawn by the drawing unit (10) with linear guidance by the linear guide (22).

The working tool (3) is in turn linearly guided along the longitudinal axis (5) of the holder (6) by means of the linear guide (22) and can be rotated by a rotating unit (15) and/or drawn by the drawing unit (10). This configuration includes the option of moving only the working tool (3) by way of the rotating and/or drawing unit (10, 15), or of moving only the retaining unit (20) using the rotating and/or drawing unit (10), or moving both the working and the retaining units (3, 20) relative to each other.

A cylindrical pipe (2) having a smaller pipe cross-section (16) is held by a further retaining unit (20*a*) comprising a clamping unit (21*a*) in alignment with the longitudinal axis (5) of the holder (6) and is guided along the longitudinal axis (5) of the holder (6) by means of the linear guide (22) so that it can be inserted into the end region (19) of the pipe (2) having the larger cross-section (17) which is to be conically deformed so as to be fixed to this pipe.

Figures 12A, 12B, 12C, 12D, 12E, 12F:
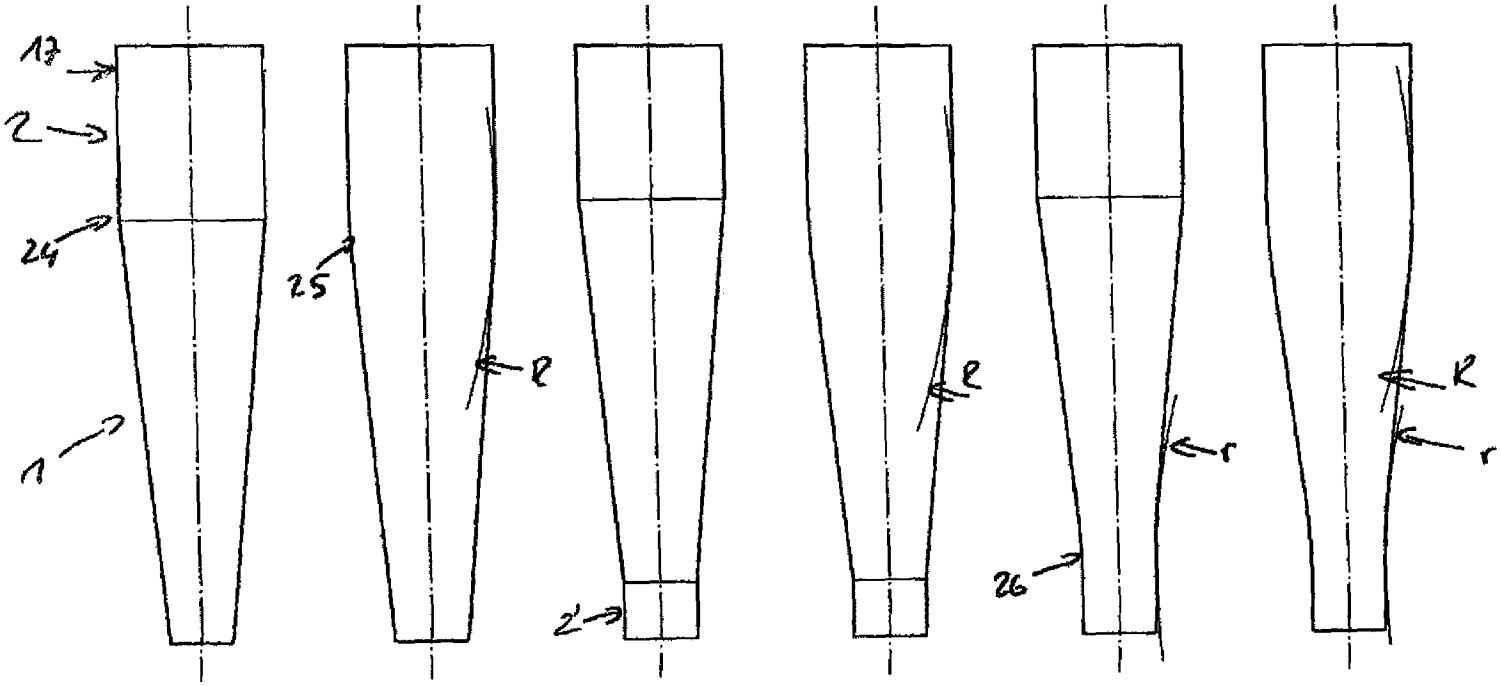
FIGS. 12 *a* to *f*: show six different basic shapes of a single-piece ground screw foundation according to the invention.

FIGS. 12 *a* to *f* show different embodiments of a single-piece basic ground screw foundation shape. FIG. 12 *a* shows a base body of a ground screw foundation having a cylindrical pipe section 2, which transitions into a conically tapering pipe section 1. The cylindrical pipe section 2 has an outside pipe diameter D at the larger cross-section 17. A bend-shaped transition 24, which is to say an edge, is formed between the cylindrical and conical pipe sections. The edge is shown by the peripheral line on the base body. In contrast, FIG. 12 *b* shows the transition by way of a tapering, convex region 25. The lateral region of the basic ground screw foundation shape transitions continuously, which is to say essentially without an edge, from a cylindrical section 2, via the convex transition region 25, into the conical section 1.

FIGS. 12 *c* to *f* have an S-shaped contour, which is to say the basic shape of the ground screw foundation has two cylindrical pipe sections 2, 2', between which a conical section 1 is formed. The second cylindrical pipe section 2' has a diameter d. The transitions between the cylindrical sections 2, 2' and the conical section 1 are designed as bend-shaped transitions 24, respectively, according to FIG. 12 *c*. In contrast, FIG. 12 *d* shows the transition between the cylindrical pipe section 2 and the conical pipe section 1 as a continuous, convex transition region 25. The convex radius R is at least five times the pipe diameter D at the larger cross-section 17 of the cylindrical pipe 2. According to FIG. 12 *e*, which shows a variant of the embodiment of FIG. 12 *c*, the transition between the conical section 1 and the cylindrical pipe section 2' is designed as a concavely tapering transition region 26. The embodiment according to FIG. 12 *f* has a convex transition 25 between the cylindrical pipe section 2 and the conical pipe section 1, and a concave transition region 26 between the conical section 1 and the cylindrical pipe section 2'. With such an embodiment having at least one concave or a convex transition 25, 26, the conical section 1 can also be designed infinitesimally short, so that the length thereof moves toward zero and a continuous transition occurs from the convex region 25 into the concave region 26.

Figure 13:
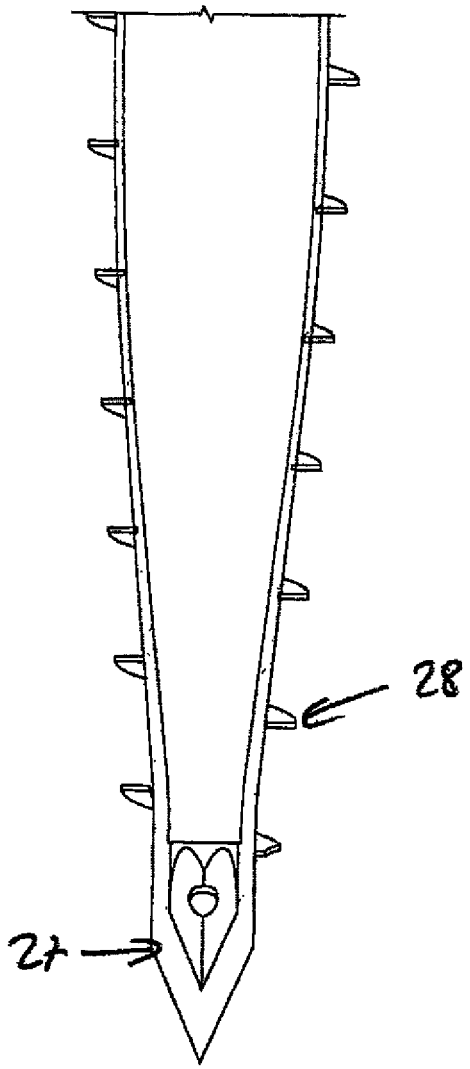
FIG. 13: shows a single-piece ground screw foundation according to the invention.
Figures 14A, 14B, 14C, 14D, 14E, 14F:
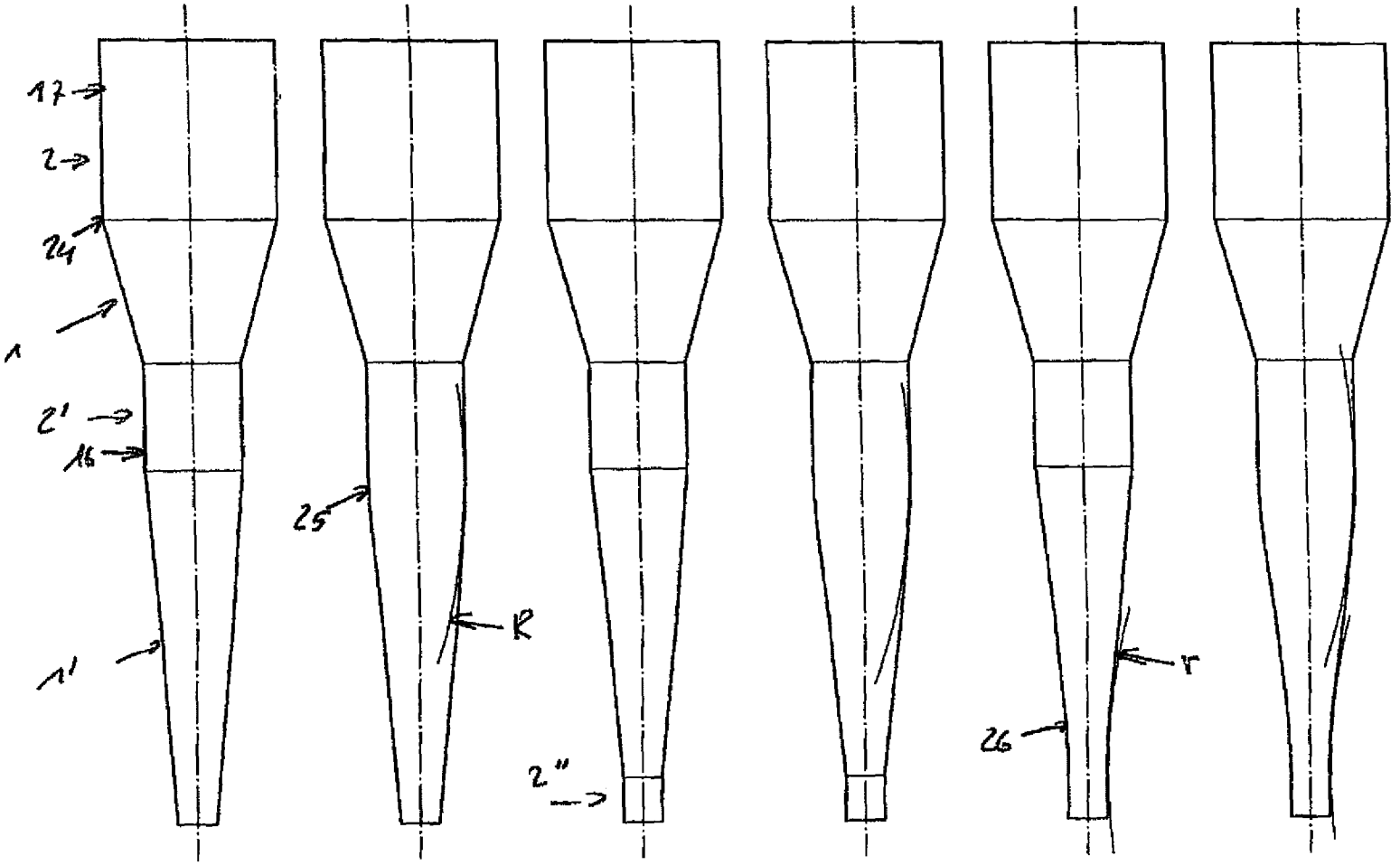
FIGS. 14 *a* to *x*: show twenty-four different basic shapes of a two-piece ground screw foundation according to the invention.
Figures 14G, 14H, 14I, 14J, 14K, 14L:
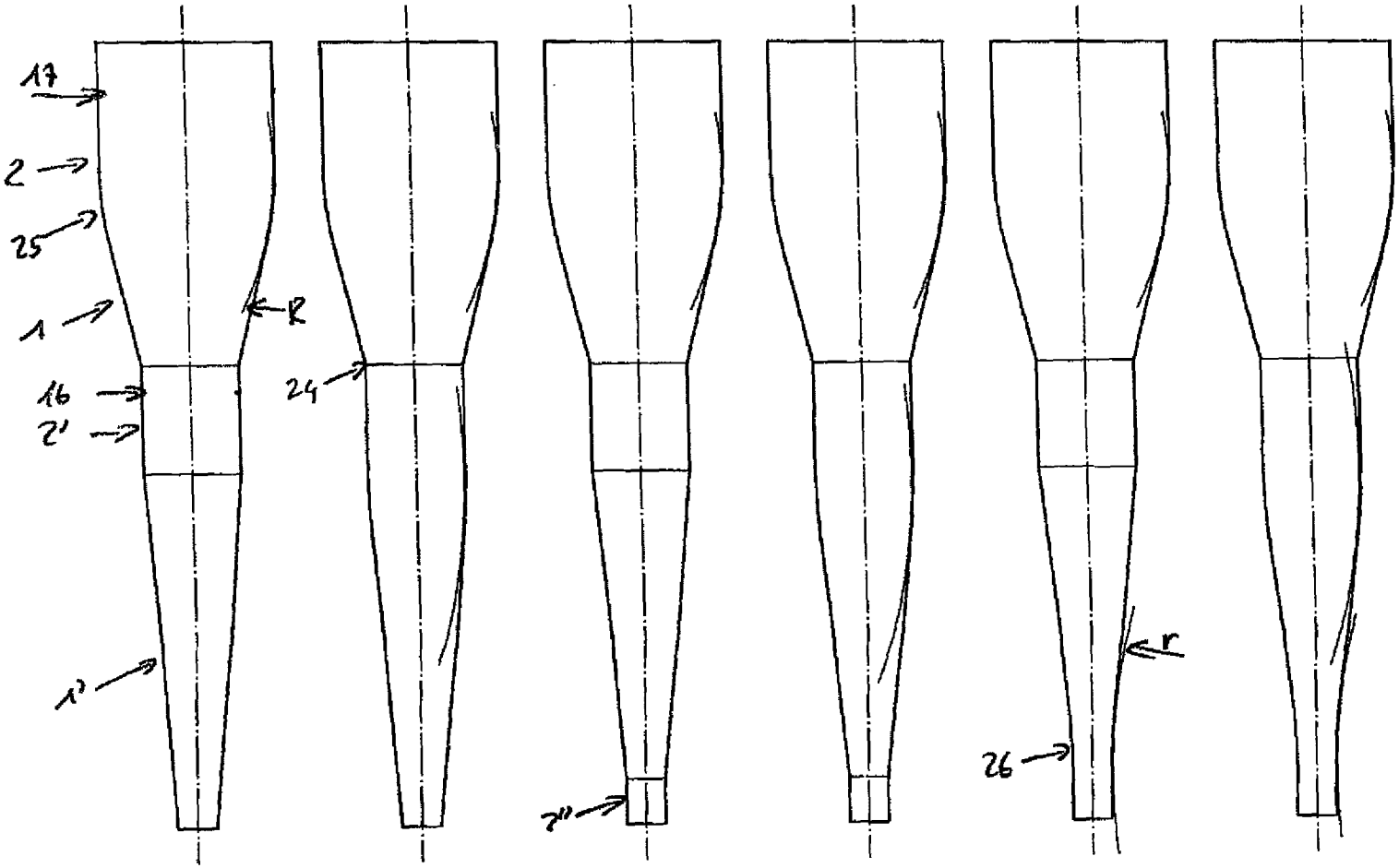
Figures 14M, 14N, 14O, 14P, 14Q, 14R:
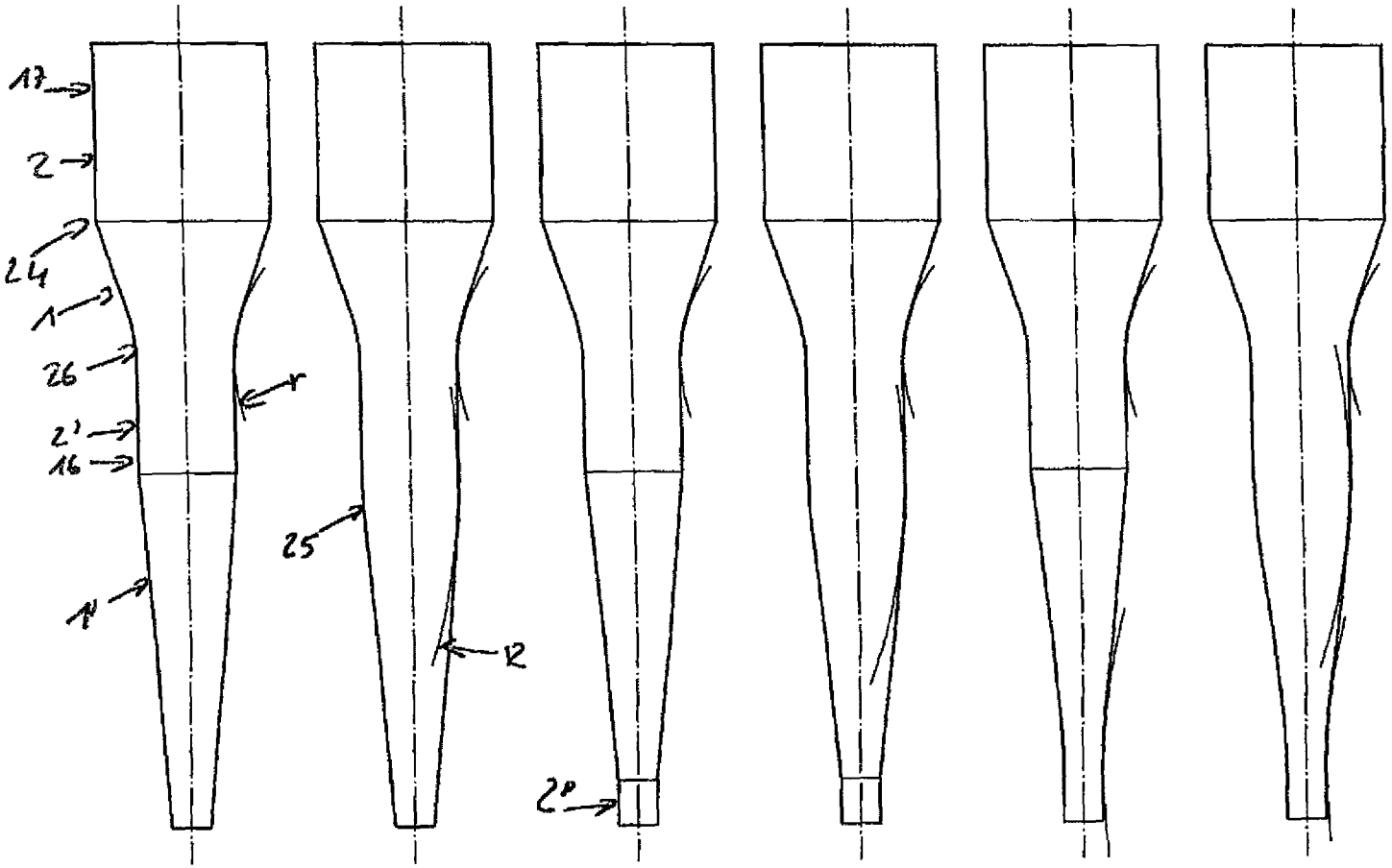
Figures 14S, 14T, 14U, 14V, 14W, 14X:
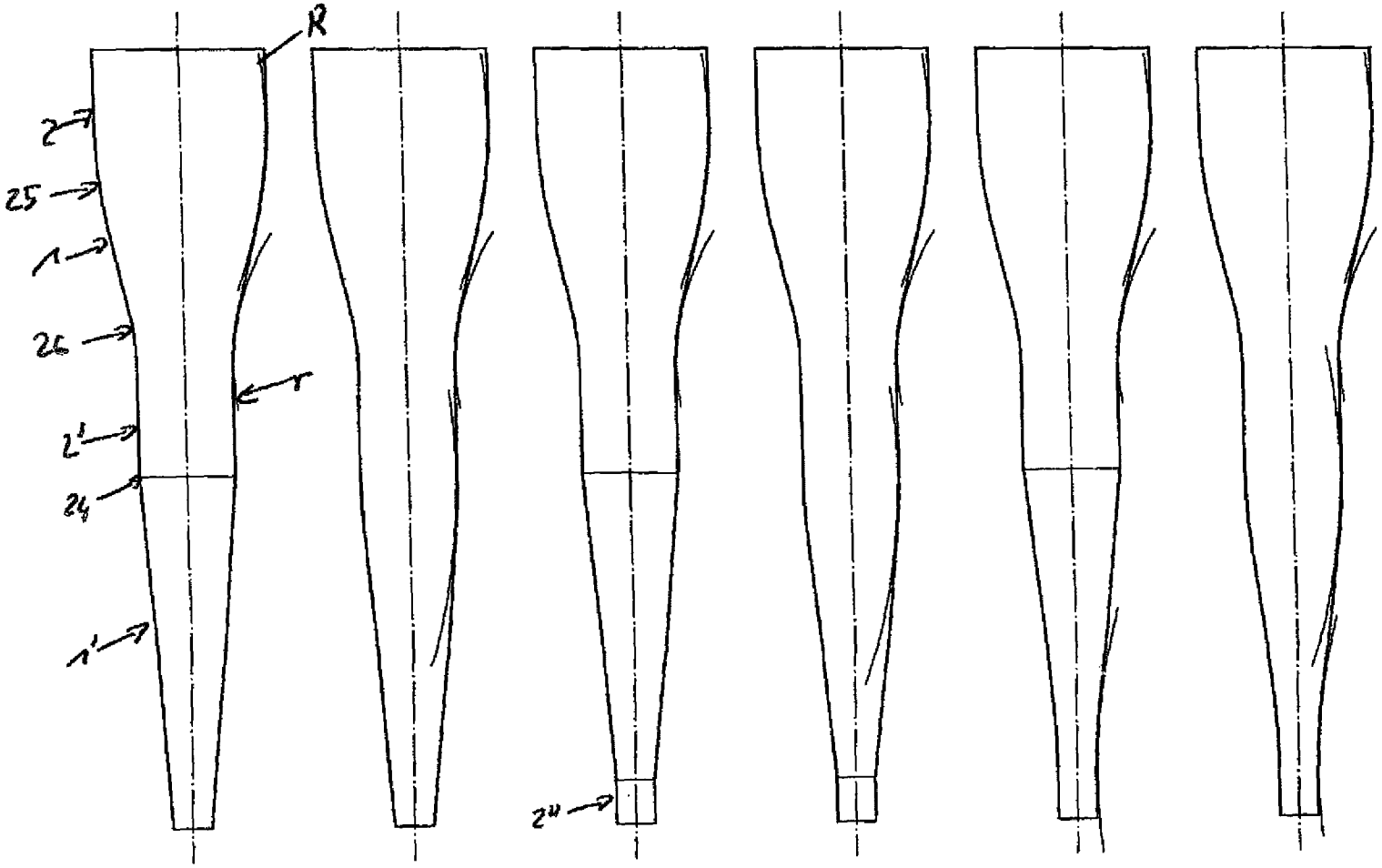

FIG. 13 shows a single-piece base body of the ground screw foundation according to FIG. 12 *f*, which was produced by the method according to the invention and in which, in further method steps, a tip 27 is forged and a screw helix 28 is welded on the periphery.

FIGS. 14 *a* to *x* show the basic shapes of different two-piece ground screw foundations produced by a method according to the invention, wherein the basic shapes can essentially be produced by combining the single-piece variant of the basic shapes according to FIGS. 12 *a* to *f*. As is shown in FIGS. 9 *a* to *c*, the two elements of the two-piece design are joined between the cylindrical end region of the first pipe having the smaller pipe cross-section 18 and the conically deformed end region of the second pipe having the larger pipe cross-section 19. A joining region, in which the two cylindrical pipes 2 are connected by way of press fit, is shown in detail A of FIG. 15.

The embodiments according to FIGS. 14 *a, b, g, h, m, n, s, t* have two substantially tubular sections 2, 2' and have a conical section 1' at the lower end. The remaining embodiments have three tubular sections 2, 2', 2" and two conical sections 1, 1' arranged downstream between two tubular pipe sections 2, 2', 2", respectively. The transitions between the individual sections are designed as a bend-shaped transition 24, as a convex transition region 25, or as a concave transition region 26.

Figure 15B:
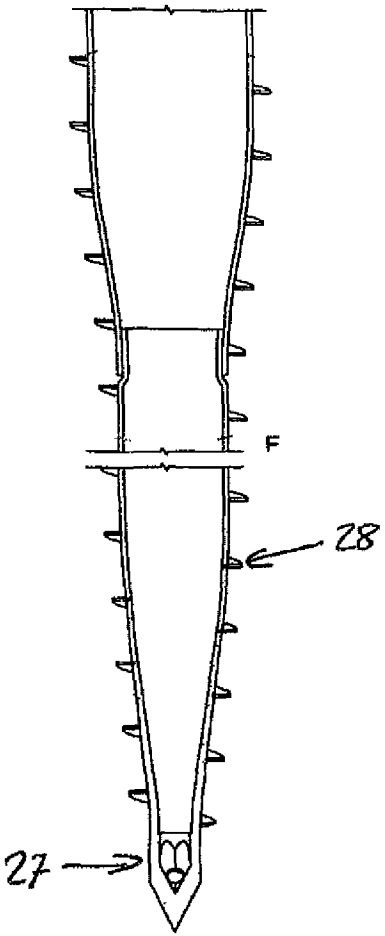
FIGS. 15*a* and *b*: shows a two-piece ground screw foundation according to the invention.
Figure 15A:
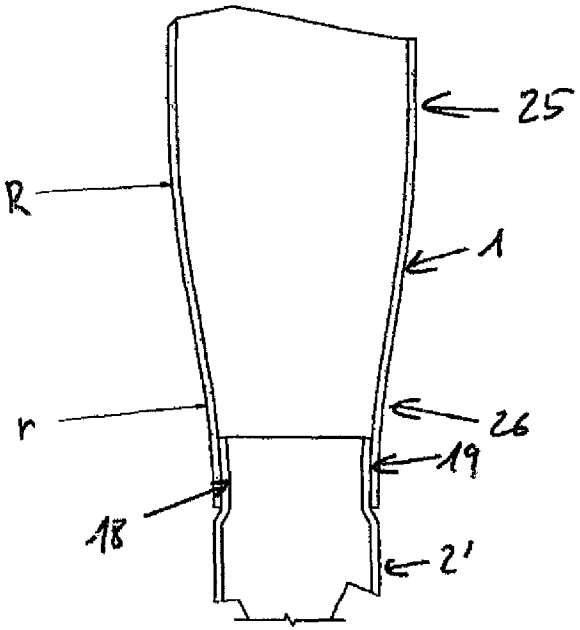

FIG. 15*a* shows a two-piece basic shape according to FIG. 14 *x*, which in a further work step is provided with a tip 27 and a screw helix 28, so that it can be used as a ground screw foundation.

FIG. 15*b* shows the joining region in more detail, in which the two pipes 2 overlap.

The invention claimed is:

1. Apparatus for producing at least one longitudinal section on a cylindrical pipe thereby to provide a ground screw foundation for attaching an object to the ground, comprising:

a working tool and a drawing unit;

wherein the working tool is comprised of at least one spring element and a plurality of press roll disks or press roll disk segments;

wherein the press roll disks or press roll disk segments are disposed radially around a longitudinal axis of a holder for the cylindrical pipe that is to be drawn, and pivotably around shafts extending transversely and tangentially relative to the longitudinal axis;

wherein said at least one spring element provides a preload force that preloads the press roll disks or press roll disk segments so that the press roll disks or press roll disk segments are seated with friction fit against the pipe inserted into the holder;

wherein the shafts, the press roll disks or press roll disk segments, and the at least one spring are configured so that the press roll disks or press roll disk segments pivot in a direction against said preloading force about respective axes defined by the shafts in response to a relative movement between the pipe and the working tool along the longitudinal axis, thereby to draw the pipe;

wherein said pivoting of the press roll disks or press roll disk segments during said relative motion occurs without applying a drive force at said corresponding shafts for said press roll disks or press roll disk segments;

wherein outer circumferential surfaces of the disks or disk segments are configured to roll off on the pipe for imparting a tapering shape to said at least one longitudinal section as the pipe is drawn; wherein each one of the spring elements is connected to a corresponding one of the press roll disks or press roll disk segments at a radial distance from a corresponding one axis of said respective axes defined by a corresponding one of the shafts; and wherein said each one of the spring elements exerts a rotational force on said corresponding one of the press roll disks or press roll disk segments about said corresponding one axis.

2. The apparatus according to claim 1, wherein the working tool is held in a stationary manner and the drawing unit is movable along the longitudinal axis.

3. The apparatus according to claim 1, wherein the pipe is held stationary by a retaining unit of the drawing unit and the working tool is movable along the axis.

4. The apparatus according to claim 1, wherein the pipe and the working tool are relatively movable toward each other along the longitudinal axis.

5. The apparatus according to claim 1, further comprising a clamping unit for clamping the pipe.

6. The apparatus according to claim 5, wherein the clamping unit is self-locking.

7. The apparatus according to claim 1, further comprising a linear guide for guiding elements of the apparatus in direction of the longitudinal axis.

8. The apparatus according to claim 1, wherein the at least one spring element comprises a gas spring.

9. The apparatus according to claim 1, further comprising a synchronous coupling of the press roll disks or press roll disk segments to each other.

10. The apparatus according to claim 9, wherein the synchronous coupling of the press roll disks or press roll disk segments comprises teeth on the press roll disks or press roll disk segments.

11. The apparatus according to claim 1, wherein the press roll disks or press roll disk segments number at least 18.

12. The apparatus according to claim 1, wherein selected individual or groups of the press roll disks or press roll disk segments are radially disengageable in relation to other of the press roll disks or press roll disk segments.

13. The apparatus according to claim 1, further comprising at least one additional set of press roll disks or press roll disk segments, the press roll disks or press roll disk segments of each of the sets being of different size from those of each of the other sets and the sets being interchangeably receivable by the working tool.

14. The apparatus according to claim 1, wherein the drawing unit is a multi-step drawing unit.

15. The apparatus according to claim 1, further comprising a rotating unit for rotating the pipe about a longitudinal axis thereof during drawing or between drawing steps of a multi-step drawing operation.

16. The apparatus according to claim 1, wherein the press roll disks or press roll disk segments number 24.

17. The apparatus according to claim 1, wherein the press roll disks or press roll disk segments number 28, 32 or 36.

18. The apparatus according to claim 1, wherein each one of the press roll disks or disk segments has a curved contour configured to engage the pipe so as to impart said tapering shape when said one at said curved contour rolls off on the pipe.

19. The apparatus of claim 1, wherein the shafts are at a fixed distance from the longitudinal axis.

20. The apparatus of claim 1, wherein the outer circumferential surface of the press roll disks or press roll disk segments have a decreasing radius.

21. The apparatus of claim 1, wherein the spring elements exert a rotational force on the press roll disks or press roll disk segments.

* * * * *